United States Patent [19]

Gombault

[11] Patent Number: 4,606,534

[45] Date of Patent: Aug. 19, 1986

[54] COMBINED SEPARATING, BURSTING AND SORTING APPARATUS FOR A CONTINUOUS WEB OF MULTI-FORMS

[75] Inventor: Jacobus F. Gombault, Drachten, Netherlands

[73] Assignee: Hadewe B.V., Drachten, Netherlands

[21] Appl. No.: 785,550

[22] Filed: Oct. 8, 1985

[30] Foreign Application Priority Data

Oct. 8, 1984 [NL] Netherlands ..... 8403057

[51] Int. Cl.[4] ..... B65H 41/00

[52] U.S. Cl. ..... 270/52.5; 225/5; 225/106

[58] Field of Search ..... 270/52.5; 101/2; 225/5, 225/21, 23–24, 27, 32, 88, 90, 98, 106

[56] References Cited

U.S. PATENT DOCUMENTS

| | | | |
|---|---|---|---|
| 2,090,585 | 8/1937 | Waechter | 225/5 |
| 2,291,754 | 8/1942 | Plazze | 225/106 |
| 2,368,683 | 2/1945 | Sherman | 270/52.5 |
| 2,618,336 | 11/1952 | Davidson | 225/5 |
| 2,778,424 | 1/1957 | Hageman et al. | 225/106 |
| 3,797,719 | 3/1974 | Tall et al. | 225/106 |
| 3,972,283 | 8/1976 | Jennings | 270/52.5 |
| 4,261,497 | 4/1981 | Roetter et al. | 225/106 |
| 4,397,410 | 8/1983 | Schueler | 225/98 |
| 4,473,218 | 9/1984 | Dudek | 270/52.5 |

*Primary Examiner*—E. H. Eickholt

*Attorney, Agent, or Firm*—Burns, Doane, Swecker & Mathis

[57] ABSTRACT

A combined separating, bursting and sorting apparatus for a continuous web of multi-forms having sheet divisions fixed by perforation lines, provided with a bursting device, a path of travel, and a sorting device consisting of a plurality of receptacles for separated and bursted sheets, said path of travel beginning at a plurality of plate-shaped infeed elements with connected, elongated, tensioned guide elements which extend substantially linearly to a deflection at a receptacle, which infeed elements for inserting a layer of the continuous web of multi-forms are capable of being deflected or swivelled away from each other and are combined to a packet by inserting thin distance plates in the side edge regions on both sides of the path of travel and the guide function of a guide element receding at the point of deflection is taken over by a guide plate which extends to the next deflection and follows same, and adjoins the path of travel on one side, the other side of which is formed by belt conveyor means or by conveyor wheels.

8 Claims, 6 Drawing Figures

FIG. 1
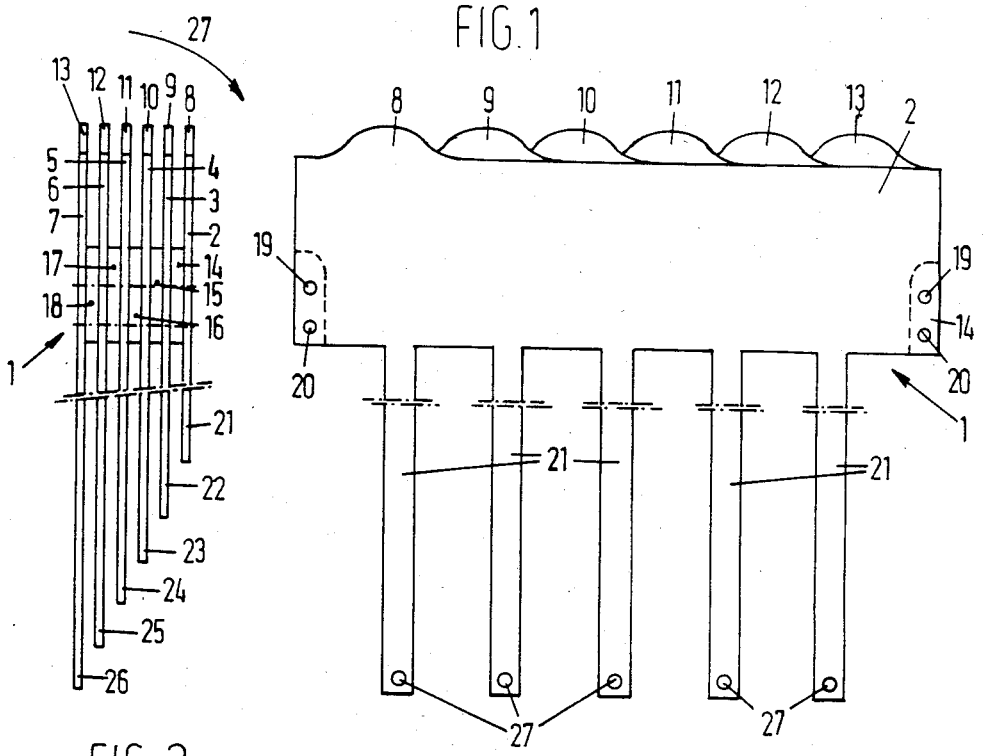
FIG. 2
FIG. 3
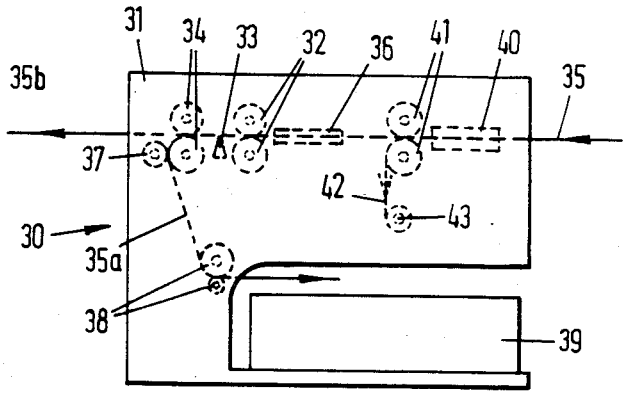
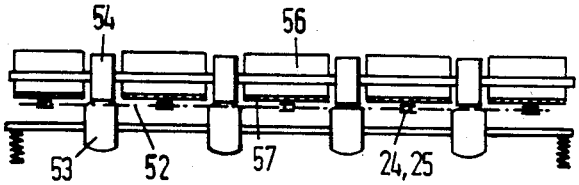
FIG. 6

COMBINED SEPARATING, BURSTING AND SORTING APPARATUS FOR A CONTINUOUS WEB OF MULTI-FORMS

The invention relates to a combined separating, bursting and sorting apparatus for a continuous web of multi-forms having sheet divisions fixed by perforation lines, provided with a bursting device for subdividing said continuous web along the perforation lines, a path of travel for conveying said continuous web in separated condition, and a sorting device consisting of a plurality of receptacles for separated and bursted sheets of said continuous web, said bursting device consisting of an infeed, a bursting knife edge, and an outfeed provided with a pair of outfeed rollers, and said path of travel for conveying said continuous web in separated condition beginning before the bursting knife edge at a separating device having a plurality of plate-shaped infeed elements to which are connected one or a plurality of elongated guide elements which extend substantially linearly to a deflection at a receptacle and are capable of being tensioned in their longitudinal direction by tension elements engaging with their ends, at least said pair of outfeed rollers being provided with circumferential recesses or interruptions for bunchwise unaffectedly passing the guide elements.

Such a combined separating, bursting and sorting apparatus is known from European patent application 94,647. In this apparatus the elongated guide elements ensure that the continuous web of multi-forms is fed to the bursting device in separated condition and a plurality of superimposed sheets are moved away from said device in separated condition, said sheets being severed from said continuous web along the perforation lines in the bursting device, so that each of these sheets can be automatically fed to its respective receptacle. Thus a packet of sheets can be severed with one bursting device without resulting in a stack of sheets to be separated that are hard to handle. These problems, however, have now been shifted to the infeed and outfeed of the separating device. At the infeed the continuous web of multiforms is to be inserted into narrow slits, i.e. each layer into one slit, the successive slits being offset stepwise in the direction of travel. The continuous web of multi-forms must therefore be separated into a plurality of layers and carefully inserted into the successive slits over different lengths without crinkling the often thin paper or inserting same out of alignment. At the outfeed the guide elements diverge, as a result of which the separate sheets conveyed by the outfeed rollers of the bursting device must move further over the stationary guide elements in free position, i.e. not guided at their top side, which may lead to bulging and thus to obstructions and failures in the outfeed. This effect is aggravated by the fact that for severing a packet of sheets the speed of the outfeed rollers is doubled temporarily, that is to say, the leading parts of the individual sheets which are then no longer comprised between the guide elements, i.e. only supported by the subjacent stationary guide elements, are all subjected to a sudden accelerating force, so that the undesired bulging effect is substantially increased and it becomes more questionable whether a stack of sheets superimposed in flat and smooth condition can be formed.

According the invention there is provided an apparatus for severing a plurality of sheets superimposed in separated condition from a continuous web of multi-forms, in which said web is easily and rapidly inserted into the separating device with a minimum of disturbance of said web, and therefore with a minimum risk of crinkling, and in which the sheets severed in the bursting device each remain in their own path of travel and are compulsorily conveyed therein to adjacent their place of deposit in their respective receptacles in bilaterally held and guided condition.

According to the invention this is accomplished with an apparatus of the type referred to in the opening paragraph in that the infeed elements for inserting a layer of the continuous web of multi-forms are capable of being deflected or swivelled away from each other and are combined to a packet by inserting thin distance plates in the side edge regions on both sides of the path of travel and the guide function of a guide element receding at the point of deflection is taken over by a guide plate which extends to the next deflection and follows same, and adjoins the path of travel on one side, the other side of which is formed by belt conveyor means or by conveyor wheels.

These steps admit rapid and simple feeding by allowing the leading edge of the continuous web of multi-forms to slightly overlap the infeed elements and, for instance, bending both upwardly and alternately allowing an infeed element and a leading edge to return to the horizontal plane. Of course, also other methods are possible to insert the overlapping parts lengthwise into each other. The distance plates between the infeed elements provide, on the one hand, guidance and, on the other hand, a sufficient margin for allowing a continuous web of multi-forms inserted in separated condition to be pushed and pulled further to a conveyor means. After subdividing the web thus inserted in separated condition the sheets dispensed by the outfeed rollers of the bursting device are moved further by the belt conveyor means or conveyor wheels, a continuous separated guidance of the sheets in the desired manner being provided by the guide elements. This guidance is maintained until a sheet has reached its place of deposit and at least the leading edge moves in the desired direction of deposit, which is obtained by allowing a guide element and a guide plate to deflect accordingly.

Since each sheet is compulsorily conveyed in bilaterally held position from its insertion in the separating device to practically its collection in a receptacle, crinkling, wrinkling, bulging etc. of the sheet is nearly impossible, so that failures or obstructions in conveying the forms have been reduced to a minimum.

It is preferred to keep the continuous web of multi-forms as thin as possible despite the inserted separating and guide means for passing through the bursting device. This object is attained in a satisfactory manner, if in accordance with a further embodiment of the invention the infeed elements consist of flexible synthetic plates which, in the part of the side edge regions that is in downstream position, looking in the direction of travel, are provided with means for engaging with tension elements capable of tensioning the plates transversely to the direction of travel, and the guide elements consist of strips which are integral with each synthetic plate. Thus it is possible to work with a very thin material which, true, has insufficient rigidity of its own to serve as a guidance, but receives that property from the tension developed therein. The step of transversely tensioning the infeed elements of the separating device not only ensures undisturbed conveyance of the continuous web of multi-forms through the separating device, but also renders it possible to deflect the upstream plate portions of the separating device together or individually from the plane of travel for the purpose of separately inserting the leading end of a continuous web to be inserted. The step of securing by transversely tensioning the infeed elements also renders it possible to make them of a very thin material, i.e. the same material as that of the guide elements, so that an infeed element with connected guide elements can be made as one piece of material, which avoids fastening problems at the point where infeed element and guide elements merge into each other. The fastening will not lead to an increase in thickness and therefore not cause any irregularity in the path of travel.

Deflection and keeping a guide element under tension without causing problems for dispensing a sheet to a receptacle can be advantageously realized in accordance with a further embodiment of the invention, if a guide element is deflected by passing it first over the part of the guide plate following the deflection and then around a nose formed at the next guide plate, while over at least the distance over which the guide element abuts against the guide plate an adjacent driven conveyor pulley can be operative.

If, in addition, the belt conveyor means are capable of being removed or swivelled away as a whole and the guide plates are capable of being swivelled around the axis of the driven conveyor pulley, the guide system is within easy reach by swivelling away or removing the belt conveyor means, while the tension can be removed from the guide elements by swivelling away the guide elements. In case of breakdown, e.g., as a result of accumulation or obstruction of paper between the guide elements, it is thus possible to simply make the apparatus effectively accessible for the purpose of eliminating this trouble.

In order to promote correct dispensing of a sheet to a receptacle when leaving the guide system, it is preferred according to a further embodiment of the invention that the driven conveyor pulley cooperates with a lower pulley in a place where a guide element has left its path around the circumference of the conveyor pulley by tensioning around the nose.

In order to construct also a single bursting device, the infeed of which is provided with a pair of infeed rollers, and thus the whole device, as compactly as possible, it is preferred according to a further embodiment of the invention that both pairs of rollers of the bursting device are capable of being driven at the same speed and means are provided for halting the pair of infeed rollers. These steps admit not only to keep the length of the bursting device as short as possible because the distance between the two pairs of rollers is independent of the length of a sheet to be severed, but also to use only one drive unit for the entire conveyor and bursting system. Moreover, an appropriate control of the halting of the pair of infeed rollers enables processing of successive sheets having different lengths.

Since the bursting device makes use of a pair of infeed rollers capable of being stopped for the purpose of subdividing the continuous form into sheets, the apparatus according to the invention is eminently suited for use in operative association with equipment which recedes or follows it, and this in particular if in accordance with a further embodiment of the invention the means for halting the pair of infeed rollers are controllable by an upstream device, e.g., a printer and/or a downstream device e.g., a folding and/or filling device. Thus the separating, bursting and sorting steps can be carried out automatically and controlled by the speed of the equipment determining the process.

The combined separating, bursting and sorting apparatus according to the invention will be further discussed and elucidated hereinbelow, with reference to the examples of embodiment illustrated in the drawing.

FIG. 1 is a front view of a separating device with connected guide means in unmounted condition;

FIG. 2 is a side view of FIG. 1;

Figure 4:
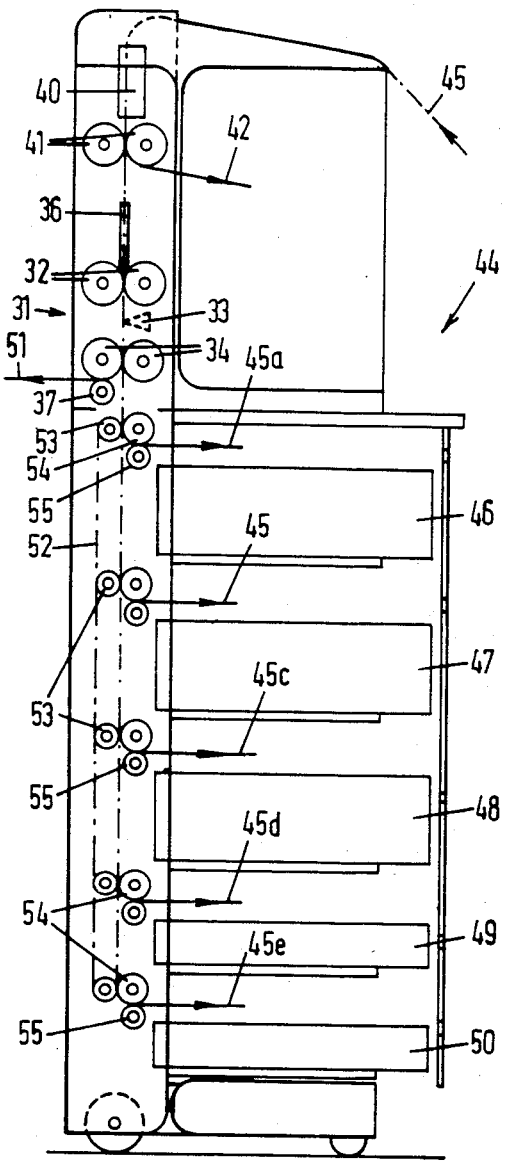
Figure 5:
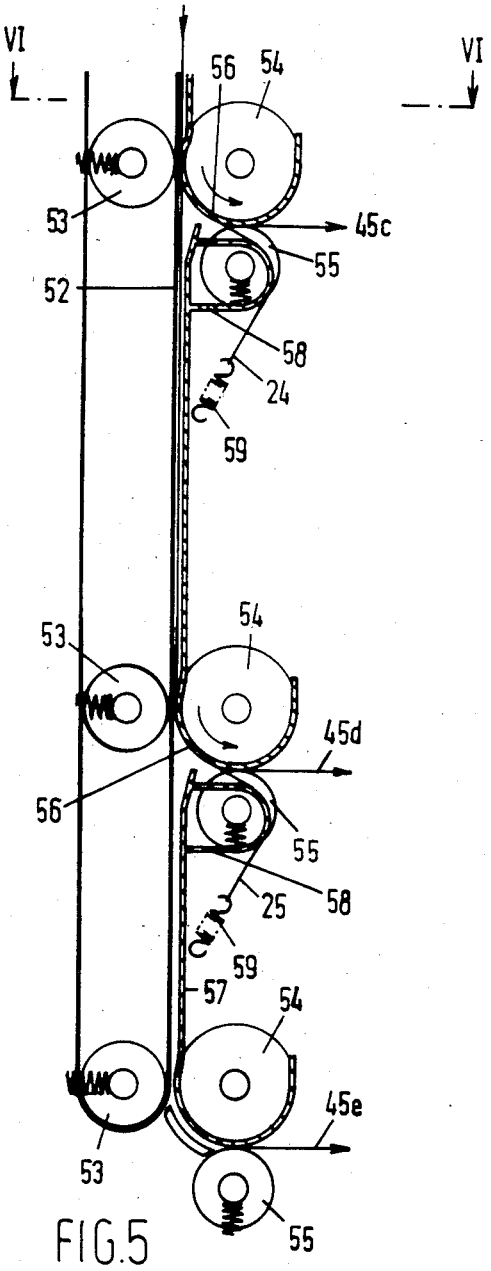

FIG. 3 schematically shows an embodiment of the combined separating, bursting and sorting apparatus according to the invention;

FIG. 4 schematically shows a second embodiment;

FIG. 5 shows a cross-section of a part of a sorting device with mounted guide means; and FIG. 6 is a cross-section taken through VI—VI of FIG. 5.

As shown in FIGS. 1 and 2, a separating device 1 consists of six plate-shaped elements 2–7 made of a thin flexible synthetic material being, for clarity's sake, a considerably enlarged view, each of said elements being provided with a lip-shaped projecting part 8–13, which parts are offset one in relation to another. The plate-shaped elements are composed packetwise with insertion of two distance plates 14–18 between two plate-shaped elements in the side edge regions thereof. At the distance plates two bores 19, 20 extending through the whole packet are provided in each side edge region. These bores serve for receiving means with which the packet can both be compressed and be tensioned perpendicularly to the side edges.

Starting from each plate-shaped element 8–13 and integrally formed therewith, guide means are present in the form of guide elements 21–26, five per plate-shaped element. The five guide elements starting from each plate-shaped element all have the same length and are provided at their free ends with a bore or opening 27 for receiving tension elements for longitudinally tensioning the guide elements. The length of guide elements 21–26 depends on the length of the path of travel to be determined leading to a receptacle. In general, the length of the five guide elements 21 will be different from that of the other quintets of guide elements 22–26, which quintets will also have mutually different lengths. This is shown in FIG. 2 by applying different numbers of interruptions in the guide elements.

In order to separate a continuous multi-form, it should be fed in the plane of separating device 1 on the side of the lip-shaped projecting parts 8–13. By engaging with part 12 and thereby deflecting plate-shaped element 6, as shown by arrow 27 in FIG. 2, in the direction of plate-shaped elements 2–5 the opening between plate-shaped elements 6 and 7 is created by distance plates 18 accessible for receiving a web of the continuous multi-form. After deflection of the other webs of the continuous multi-form from the path of travel, the first mentioned web is received between plate-shaped elements 6 and 7 in flat condition by releasing the lip-shaped projecting part 12, as a result of which it returns to its starting position while holding the lip-shaped projecting part 11, so that the path of travel becomes accessible to the next web of the continuous multi-form. By repeating the above-described steps the webs can be successively positioned, after which the thus separated continuous multi-form is inserted further until it arrives at a conveyor means and is gripped by it. Such a conveyor means may be a set of driven cooperating rollers which are provided with recesses for unaffectedly passing the regions containing the stationary guide elements.

FIG. 3 schematically shows a first embodiment of the combined separating, bursting and sorting apparatus according to the invention. This combined apparatus 30 is provided with a bursting device 31 having a pair of infeed rollers 32, a bursting knife edge 33 and a pair of outfeed rollers 34. The pairs of rollers 32 and 34 are driven at the same speed until the moment when a perforation line of a continuous multi-form 35 arrives at the bursting knife edge 33. At that moment, which is determined by detecting means which are not illustrated, infeed roller pair 32 is halted by means of a clutch brake mechanism which is not illustrated either, while outfeed roller pair 34 continuous to rotate. This results in that at the bursting knife edge 33 the continuous multiform is bursted along the perforation line. All of the thus severed sheets were already separated by feeding them to a separating device 36 with connected guide elements of the above described type which are not illustrated. In order to pass the guide elements unaffectedly, the pairs of rollers 32 and 34 are provided with recesses or are each composed of a plurality of individual rollers mounted on a shaft, the mutual distance between two rollers being slightly greater than the width of a guide element.

After thus separating and bursting each sheet is individually conveyed further to its destination. For instance, as shown in the embodiment of FIG. 3, the continuous multi-form 35 consists of two webs, the subjacent sheet 35*a* of which is deposited in a receptacle 39 by means of a roller 37 cooperating with one of the rollers of outfeed roller pair 34, if required auxiliary guide means which are not illustrated, and a further roller pair 38. The superimposed sheet 35*b* is moved away to a further processing device which is not illustrated, e.g., a folding and/or filling device. The operating cycle of this apparatus can be decisive and can be used for generating a signal for restarting infeed roller pair 32 in order to start a next bursting operation. Such a signal may also originate from a printer which optionally precedes apparatus 30 and is not illustrated. If apparatus 30 is both preceded and followed by devices, a release signal for infeed roller pair 32 can be generated after a release signal has been received from each of the other devices.

Apparatus 30 is further provided with an infeed and positioning means 40 which is followed by cutting or severing means 41 for the pin guide edges often disposed along continuous forms. Severed marginal strips 42 are collected on, e.g., spools 43.

FIG. 4 shows a second embodiment of the combined separating, bursting and sorting apparatus according to the invention. In this apparatus 44 a similar infeed, separating and bursting device is used as in apparatus 30 shown in FIG. 3. Said parts are therefore designated by the same reference numerals.

In apparatus 44 as shown in FIG. 4 a quintuple continuous form 45 is fed to infeed and positioning means 40, after which the perforated marginal strips 42 are severed at roller pair 41 and moved away. After feeding the quintuple continuous form to separating device 36 the five webs with the intermediate guide elements are passed through infeed roller pair 32, over bursting knife edge 33 and through outfeed roller pair 34. By halting infeed roller pair 32 as described above, five separated sheets can be severed from the quintuple continuous form 45 by means of bursting device 31. After leaving outfeed roller pair 34 sheets 45*a*–45*e* are conveyed by means of the guide elements and conveyor means cooperating therewith and collected in five receptacles 46–50. The guide and conveyor system following outfeed roller pair 34 will be elucidated hereinafter with reference to FIG. 5. Before doing so, it is observed that also in this apparatus it is possible to move a sheet in a horizontal direction as shown by arrow 51, by means of a roller 37 cooperating with one of outfeed rollers 34, to a further device, such as a folding and/or filling device.

FIG. 5 illustrates the lower part of the sorting device according to FIG. 4 on an enlarged scale and in more detail, i.e. dispensing of sheets 45*c*, 45*d* and 45*e*. As regards the guide elements present, reference is made to FIGS. 1 and 2; it is observed in this connection that guide elements 26 have been shortened and replaced by belt conveyor means which, as shown in FIG. 6, consist of a plurality of conveyor belts 52 running over a plurality of spring-mounted guide pulleys 53.

Conveyor belts 52 define one side of a rectilinear path of travel co-axial to bursting device 31. As long as there is a sheet in said path of travel, it meets with only a slight resistance between its guide elements, which resistance is easy to overcome by means of, inter alia, conveyor belts 52 without giving rise to shifts between sheets and conveyor means.

As soon as a sheet must deflect from the rectilinear path of travel in order to be collected in a receptacle, this means a considerable increase in friction, which is compensated by locating at each path deflection a driven pulley 54 which cooperates with spring-mounted pulleys 53 and 55. Each guide element must follow the same deflected path to at least a substantial part. In order to keep the guide element out of contact with the driven pulley 54, this pulley is provided with recesses or interruptions receiving a bent part 56 of a guide plate 57, said bent part following the circumference of the pulley, and said stationary bent part 56 supporting the likewise stationary guide element. Guide plate 57 extends from the bent part 56 upwards to adjacent the bent part 56 of a next guide plate 57 where it is fitted with a nose 58, around which runs a guide element, e.g., 24 or 25 in FIG. 5, coming from a support on a superimposed bent part 56, said guide element being secured to guide plate 57 by means of spring 59.

By deflecting a guide element in the manner described a sheet running straight on beyond said deflection would not be guided on one side down to its deflection from the rectilinear path. This is avoided by applying guide plates 57 in the manner described, taking over the guide function from a deflected guide element over said distance and thus forming the other boundary line of the rectilinear path of travel, one side of which, as stated before, consists of conveyor belts 52 driven by cooperating pulleys 53 and 54, as a result of which said conveyor belts 52 and said guide pulleys 53 and further parts can be arranged in apparatus 44 conveniently and without special problems in a removable or swivelling fashion, so that in case of a breakdown, particularly obstruction, the guide system is accessible in a relatively convenient manner. This possibility can be further improved by mounting guide plates 57 in such a way that after unfastening a lock around the axis of a pulley 54, i.e. of a bent part 56, said guide plates 57 are capable of being swivelled in the direction of conveyor belts 52 which have been removed or swivelled away. By said swivelling of guide plates 57, particularly their noses 58, the tension is removed from the guide elements, which largely improves the accessibility of the paths of travel for the different sheets.

It is self-evident that many modifications and variants are possible within the framework of the invention. For instance, a guide element may also consist of a plurality of adjacent wires, and the wires of a superimposed or subjacent guide element may be staggered in relation to those of the first-mentioned guide element. Moreover, the method of fastening the ends of the guide elements, as illustrated and discussed before, is only one out of a plurality of possibilities, though it is an advantageous possibility from the viewpoint of construction and operation. A guide element may further be passed around a bent part 56 and fastened above pulley 54. In that case the sheet to be deposited is on the other side of the guide element when compared with the embodiment of FIG. 5 and has to be deflected from its rectilinear path to the receptacle by means of a guide member to be disposed. Of course, it is also possible to give the rectilinear path a direction other than the vertical one, e.g., a horizontal direction in which the sheets may be dispensed to receptacles which, e.g., are arranged in an oblique downward direction. Moreover, conveyor belts 52 may be omitted in certain cases, their function being taken over by conveyor wheels 53 or may be replaced by a conveyor band. If two forms, e.g., the original and a copy, are to remain together, this can be realized in that when inserting those two forms in the separating device, these forms are not separated, but jointly conveyed between two guide elements and deposited in a receptacle or supplied to a folding and/or filling device.

What I claim is:

1. A combined separating, bursting and sorting apparatus for a continuous web of multi-forms having sheet divisions fixed by perforation lines, provided with a bursting device for subdividing said continuous web along the perforation lines, a path of travel for conveying said continuous web in separated condition and a sorting device consisting of a plurality of receptacles for separated and bursted sheets of said continuous web, said bursting device consisting of an infeed, a bursting knife edge, and an outfeed provided with a pair of outfeed rollers, and said path of travel for conveying said continuous web in separated condition beginning before the bursting knife edge at a separating device having a plurality of plate-shaped infeed elements to which are connected one or a plurality of elongated guide elements which extend substantially linearly to a deflection at a receptacle and are capable of being tensioned in their longitudinal direction by tension elements engaging with their ends, at least said pair of outfeed rollers being provided with circumferential recesses or interruptions for bunchwise unaffectedly passing the guide elements, characterized in that the infeed elements for inserting a layer of the continuous web of multi-forms are capable of being deflected or swivelled away from each other and are combined to a packet by inserting thin distance plates in the side edge regions on both sides of the path of travel and the guide function of a guide element receding at the point of deflection is taken over by a guide plate which extends to the next deflection and follows same, and adjoins the path of travel on one side, the other side of which is formed by belt conveyor means or by conveyor wheels.

2. An apparatus according to claim 1, characterized in that the infeed elements consist of flexible synthetic plates which, in the path of the side edge regions that is in downstream position, looking in the direction of travel, are provided with means for engaging with tension elements capable of tensioning the plates transversely to the direction of travel, and that the guide elements consist of strips which are integral with each synthetic plate.

3. An apparatus according to claim 1, characterized in that the guide element is deflected by passing it first over the part of the guide plate following the deflection and then around a nose formed at the next guide plate, while over at least the distance over which the guide element abuts against the guide plate an adjacent driven conveyor pulley can be operative.

4. An apparatus according to claim 3, characterized in that the belt conveyor means are capable of being removed or swivelled away as a whole and the guide plates are capable of being swivelled around the axis of the driven conveyor pulley.

5. An apparatus according to claim 3, characterized in that the driven conveyor pulley cooperates with a back pressure pulley beside a place where a guide element has left its substantially straight path of travel, said back pressure pulley functioning as a conveyor pulley or as a guide pulley for the belt conveyor means.

6. An apparatus according to claim 3, characterized in that the driven conveyor pulley cooperates with a lower pulley beside a place where a guide element has left its path around the circumference of the conveyor pulley by tensioning around the nose.

7. An apparatus according to claim 1, in which the infeed of the bursting device is provided with a pair of infeed rollers, characterized in that both pairs of rollers of the bursting device are capable of being driven at the same speed, means being provided for halting the pair of infeed rollers.

8. An apparatus according to claim 7, characterized in that the means for halting the pair of infeed rollers are controllable by an upstream device, e.g., a printer and/or a downstream device e.g., a folding and/or filling device.

* * * * *